United States Patent [19]

Yuhasz

[11] Patent Number: 5,009,430

[45] Date of Patent: Apr. 23, 1991

[54] METHOD OF PLAYING A GEOGRAPHICAL MAP GAME

[76] Inventor: Donald E. Yuhasz, 802 S. Lucius Ave., Youngstown, Ohio 44502

[21] Appl. No.: 579,948

[22] Filed: Sep. 10, 1990

[51] Int. Cl.[5] ..... A63F 3/04; A63F 9/10; G09B 25/06

[52] U.S. Cl. ..... 273/255; 273/243; 273/157 R; 434/150

[58] Field of Search ..... 273/251–255, 273/236, 157 R, 243, 283, 284, 287, 276, 257; 434/150

[56] References Cited

U.S. PATENT DOCUMENTS

| | | | |
|---|---|---|---|
| 610,628 | 9/1898 | Jacobs | 434/150 |
| 2,004,241 | 2/1934 | Hamilton | 434/150 |
| 2,199,499 | 6/1939 | Kreitler | 434/150 |
| 2,479,747 | 8/1949 | Lachance | 273/255 |
| 3,368,816 | 2/1968 | Milazzo et al. | 273/257 |
| 3,495,833 | 2/1970 | Wesley | 434/150 |
| 3,653,668 | 4/1972 | Santianni | 273/236 |
| 3,711,966 | 1/1973 | Drcsak | 273/236 |
| 3,767,203 | 10/1973 | Eaker | 434/150 |
| 4,052,072 | 10/1977 | Beal | 273/283 |
| 4,061,336 | 12/1977 | Lincoln | 273/254 |
| 4,194,305 | 3/1980 | Smith et al. | 434/150 |

*Primary Examiner*—Benjamin Layno

*Attorney, Agent, or Firm*—Harpman & Harpman

[57] ABSTRACT

A game for teaching the skills of geography and history utilizing a map of the major continents of the world having indicia representing the profiles of topographical or political bounderies of countries. Playing pieces are provided for one to four players which match the topographical or political bounderies of the countries and indicia on each of the playing pieces identifies the countries. The playing pieces defining the various countries are placed in matching registry with the indicia representing the topographical or political boundaries of the countries on the map. Game markers are provided for the players and a series of blocks surround the map, indicia on the blocks comprise secondary directions for movement of the game pieces, the primary directions for movement of the game pieces being originated by a die or other chance indicator actuated progressively by the players.

4 Claims, 3 Drawing Sheets

METHOD OF PLAYING A GEOGRAPHICAL MAP GAME

BACKGROUND OF THE INVENTION

1. Technical Field

This invention relates to games and game boards for playing the games in which the game pieces comprise physical representations of countries and the game board comprises a map having indicia illustrating the topographical or political boundaries of the countries.

2. Description of the Prior Art

Prior games and game boards of this type have used maps having representations of topographical or political subdivisions and game pieces of a similar design having means for securing the game pieces to the maps.

See U.S. Pat. No. 610,628 wherein projecting pins on the game board register with openings in map sections to be mounted on the board.

U.S. Pat. No. 2,004,241 provides a map on a game board and game pieces representing states, the game pieces having openings therein which require registry with similarly shaped projections on the game board for assembly thereto.

U.S. Pat. No. 3,711,966 utilizes a map on a game board and provides openings in the game board located in each of the representations of political subdivisions for the engagement of flags indicating specific locations on the map.

U.S. Pat. No. 2,199,499 comprises a map of a country referred to as a pattern sheet having indicia identifying areas of the country together with a plurality of sets of individual playing pieces or cut-outs having similar indicia as well as similar color to that of the map area to facilitate matching the game pieces to the named and colored areas of the map.

U.S. Pat. No. 3,495,833 discloses a multi-layer geographical puzzle in which a top layer of a multiple layer game board is cut away in the representation of a continent and shaped representations of countries of the continent are provided for assembly in the cutaway area of the game board. No indicia as to the continent or country is present.

U.S. Pat. No. 3,767,203 provides a game board with an upstanding shape representing the outline of a country and a plurality of bottles represent political subdivisions therein, the bottles being shaped similarly to the subdivisions and each provided a neck and cap and an opening for registry with the cap and neck of another bottle.

Finally, U.S. Pat. No. 4,194,305 discloses an articulated travel and educational map with peel-off divisions. A transparent envelope is provided in which the map may be enclosed and the envelope is provided with a self-sticking adhesive so that the peel-off representations of the political subdivisions may be removably affixed thereto.

The game of the present invention utilizes a map of the major continents of the world and carries only indicia representing the profiles of topographical or political boundaries of the countries. playing pieces are provided which match the topographical or political boundaries of the countries and indicia on each of the playing pieces identifies the particular country it represents. The map of the major continents of the world is printed on otherwise illustrated on a game board and a border around the map includes a continuous row of blocks, each of which has indicia thereon guiding the players' positioning of game markers indicating the players' progress in the game. Additionally and importantly the game of the present invention utilizes playing cards which are awarded to the players upon properly placing the game pieces on the map in a predetermined time, The playing cards preferably comprising four groups, the first group carrying the indicia "roll again", the second group carrying the indicia "weapon" and "S points", the third group carrying the word "military" and the words "2 points" and the fourth group comprising the words "commander-in-chief". These playing cards control the players' actions in protecting or conquering a country, as hereinafter set forth.

SUMMARY OF THE INVENTION

A method of playing a game for teaching the skills of geography and history and utilizing a map of the major continents of the world has playing pieces matching the topographical or political boundaries of the countries on the map and carry identifying indicia. A die or other chance indicator is used by the players to advance game markers around the game board on blocks carrying indicia comprising instructions that must be followed by the player. For example, the player's marker lands on a block carrying indicia "pick a country", the player starts a timer, picks up a game piece and attempts to locate the country on the game board map that matches the game piece. If the country is located within a predetermined time, for example thirty seconds, the country is placed over its rightful position on the game board and the player receives one point. Failure to locate the country in its proper position within the predetermined time requires the game piece to be returned to a receptacle which at the beginning of the game carries all of the game pieces and the player receives no points. The same procedure is followed by each player. For example, the second player rolling the die or the other chance indicator advances his game marker on the blocks around the map on the game board and if the game marker lands on a block that says "pick two countries" the player is allowed double the predetermined time to pick up a pair of the game pieces and position them on the map. The player is awarded one point for each correctly positioned game piece representing a country. Some of the blocks on the game board carry the indicia "pick a card" and when a game marker lands on one of these blocks, the player picks up a card and holds it for military operations or to sell or trade through negotiations. There are a predetermined number of four different cards. These are "roll again" cards, "weapon" cards, "military" cards and "commander-in-chief" cards. The weapon cards each carry the notation "3 points" and the military cards each carry the notation "2 points". These values are used when these cards are traded or sold to other players.

In a specific embodiment of the invention there are three "roll again" cards, ten "weapon" cards, fifteen "military" cards and six "commander-in-chief" cards. In order that a player can conquer a country, he must have one "commander-in-chief" card, one "weapon" card and one "military" card and a rule of the game provides that the player cannot conquer another country until he passes "start" (one of the blocks) or completes one full trip around the blocks on the game board. If either of these requirements have been met, the player lays down the three appropriate cards, one military, one weapon, and the commander-in-chief card and informs the other players which country he wishes to conquer. A player can conquer only one country during his turn and gives up the right to roll the die or actuate the random choice selector. To protect a country, the player must have one "military" card and one "weapon card" and can set up a defense around any of the countries he has successfully positioned on the map as represented by the game pieces at anytime during play. A country cannot be conquered by another player if it is protected and a player protecting a given country can change protection from anyone of his countries to another at anytime during play. A tally of a player's countries may be kept.

The game board and its map illustrates the topographical or political boundaries of the countries, the game pieces match the topographical or political boundaries of the countries of the map and indicia on each of the playing pieces identifies the countries. The playing cards are an essential part of the game as they control the game and are awarded by the successful positioning of the game pieces on the map representing the several countries.

DESCRIPTION OF THE PREFERRED EMBODIMENT

Figure 1:
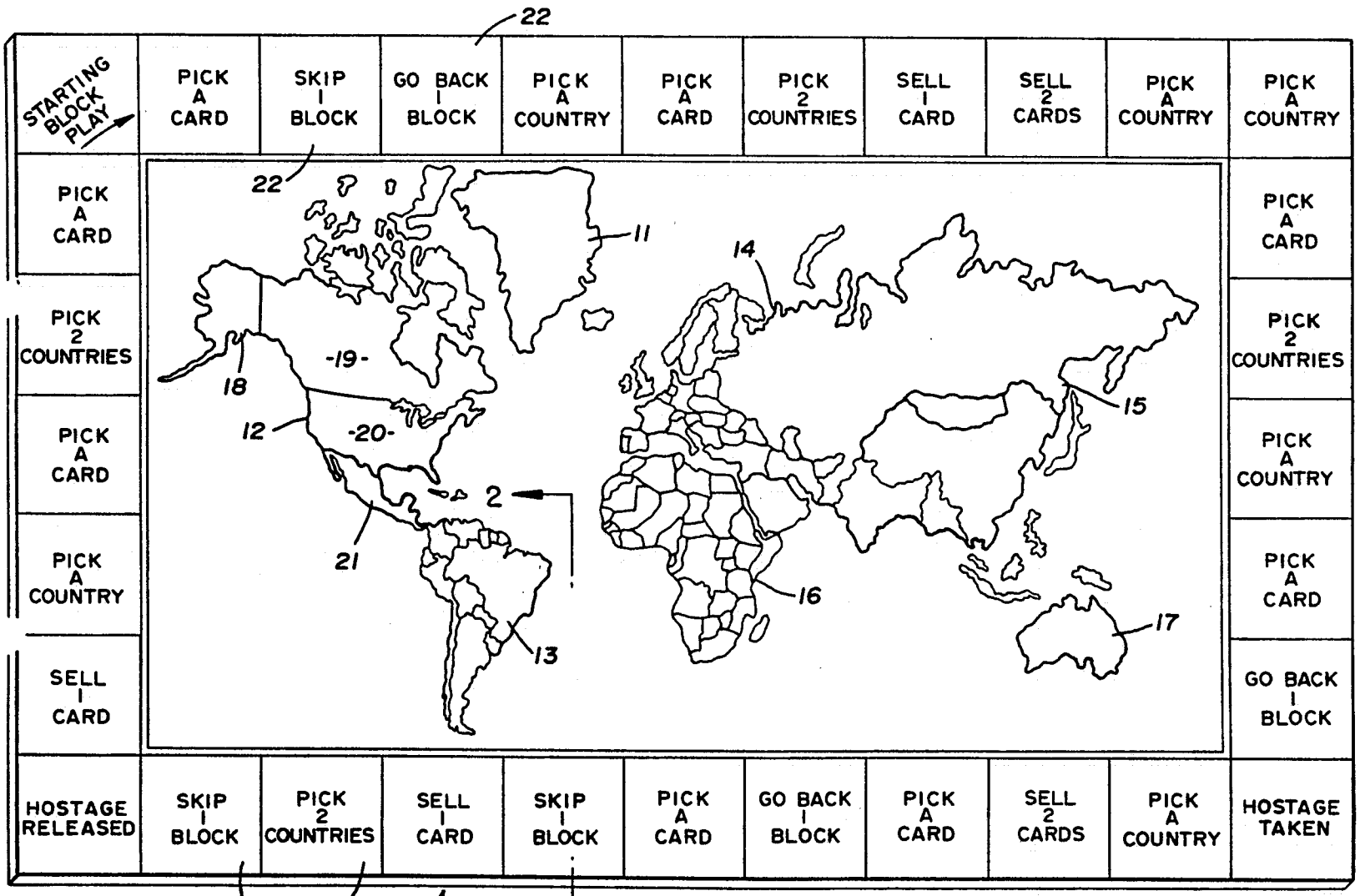
FIG. 1 is a plan view of a game board formed in accordance with the invention.

By referring to the drawings and FIG. 1 in particular, it will be seen that a game board generally indicated at 10 is dominated by the representation of a world map including several continents including Greenland 11, North America 12, South America 13, Europe-Asia 14 and 15, Africa 16, and Australia 17. Each of the continents is provided with indicia representing the topographic or political boundaries of the countries of the continent, for example North America 12 has the representation of Alaska 18, Canada 18, the United States of America 20, and Central America 21. It will be observed that in South America 13, a number of the smaller countries are shown by rather small indicia and that if desired two or more of these small countries can be combined on a single game piece to facilitate the accurate positioning of the game piece on the representation of the continent. The game board has a continuous row of blocks 22 around the representation of the maps with one of the blocks 22 carrying the notation "starting block play" and an arrow indicating a clockwise direction. Each of the successive blocks 22 thereafter has an individual indicia including the following: "pick a card", "skip one block", "go back one block", "pick a country", etc., it being understood that the players' game markers, which can be of any desired size and shape, are moved responsive to the rolling of the die or the random numeral selector as the case may be to the block indicated by the number on the die or the selector and the instructions on the block then followed. The game markers may be cubes.

Figure 3:
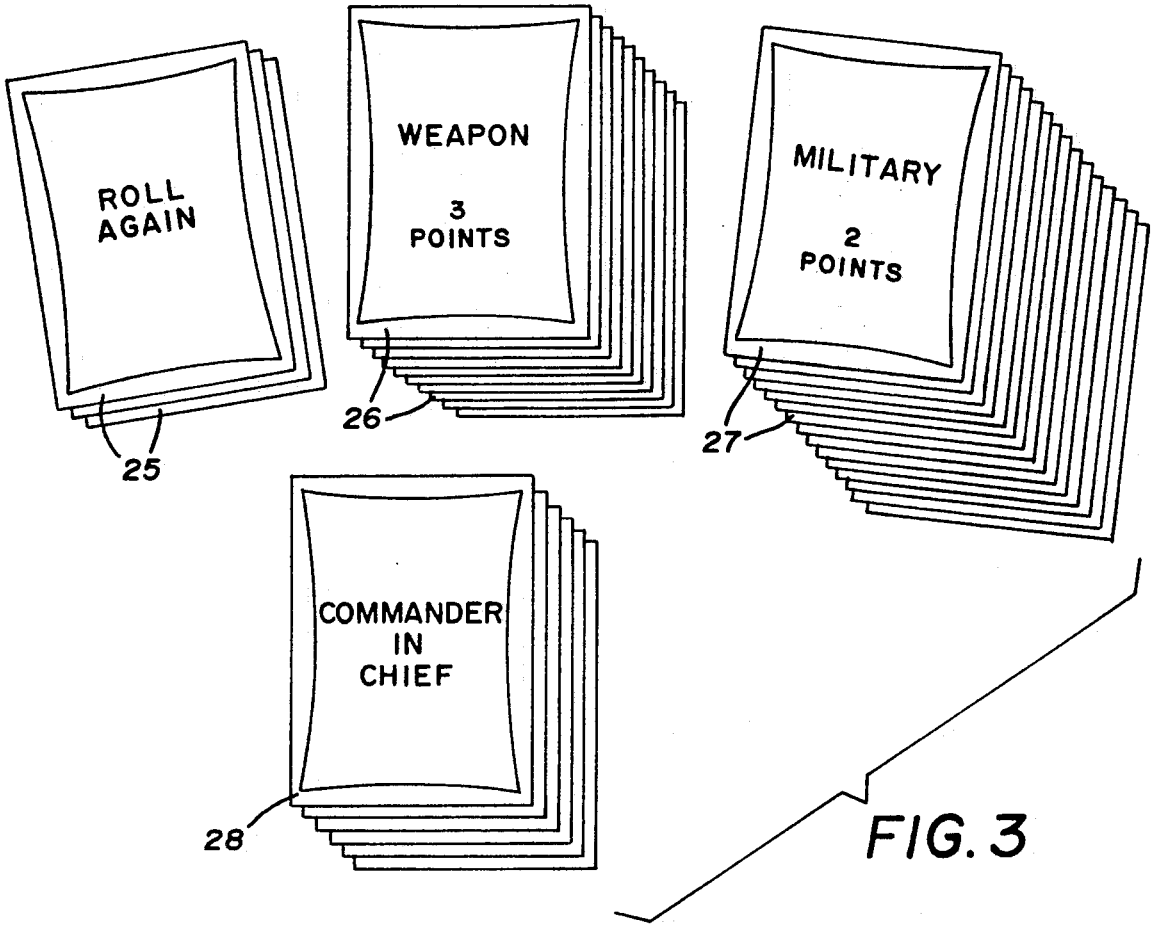
FIG. 3 is a composite illustration of four groups of playing cards used in the game.
Figure 5:
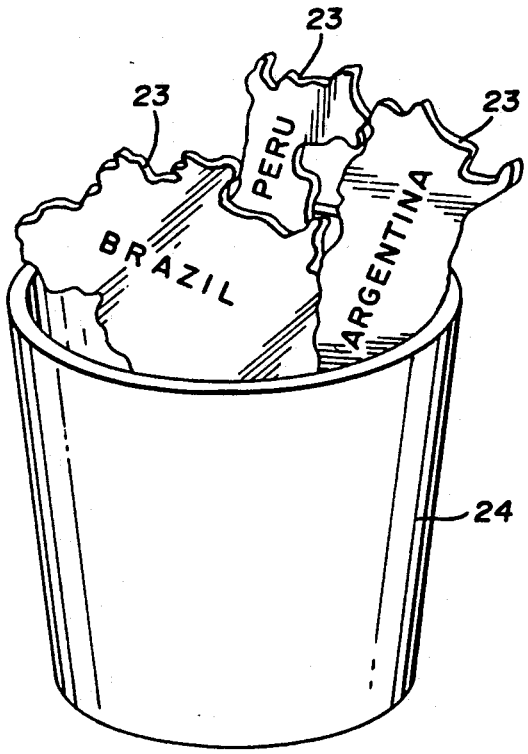
FIG. 5 is a perspective view of a receptacle with several of the game pieces positioned therein.

By referring now to the first block following the starting block 22, it will be observed that the indicia calls for "pick a card" and it will be understood that if a player rolling the die comes up with a numeral 1, he moves his game piece from the starting block to the first block and follows the directions "pick a card" by picking one of the cards of the four groups of FIG. 3 of the drawings. If he picks one of the cards marked "roll again" he then gets another roll of the die or actuation of the random number selector as the case may be and assuming he comes up with a number that moves his game marker to one of the blocks having the indicia "pick a country" he then picks a country 23 from the receptacle 24 and starts a timer, not shown, or observes a watch or a clock or any other time indicator and attempts to locate the game piece 23 on its appropriate location on one of the representations of the continents of the map of FIG. 1, for example if he picks the game piece 23 carrying the indicia "Brazil" thereon he attempts to locate the representation of the topographical or political boundaries of this country on the map and in particular the representation of the South American continent 13. The game piece may indicate its continent.

Figure 2:
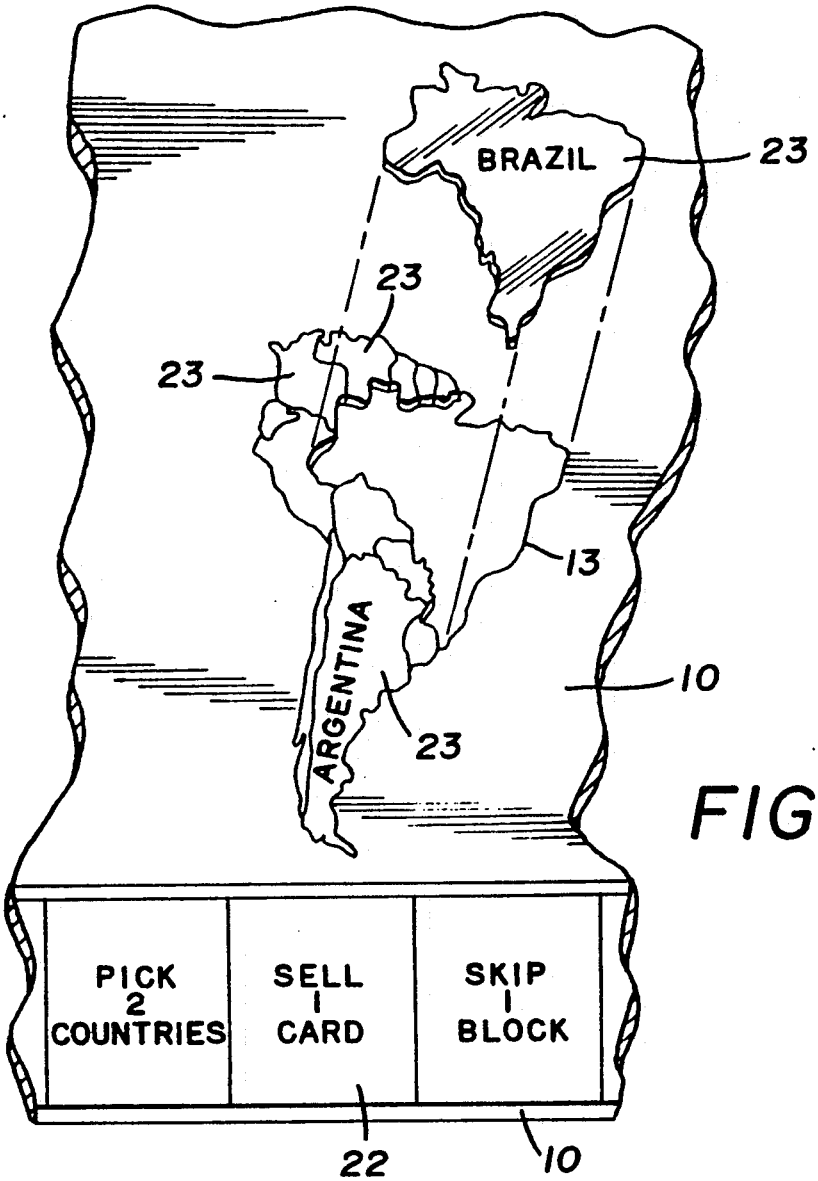
FIG. 2 is an enlarged portion of the game board of FIG. 1 showing several game pieces positioned on the indicia of the map on the game board and one of the game pieces elevated with respect to its representation on the game board.

By referring now to FIG. 2 of the drawings, it will be seen that the game piece 23 carrying the indicia "Brazil" is shown in elevated relation to the topographical or political boundaries thereof on the continent of South America and that a number of other game pieces have been positioned on their matching boundary lines, although in a number of instances, the names of the countries which appears thereon in the game have not been shown in FIG. 2 to avoid confusion. The country game piece "Argentina" is properly identified by its name and it will be understood that all of the countries which comprise game pieces are identified by their actual country names while the outline of their boundaries on the map are not identified.

As an example of the use of the playing cards in connection with the movement of the game pieces hereinbefore described, it will be seen in FIG. 3 of the drawings that there are preferably three of the "roll again" playing cards 25, ten of the "weapon" playing cards 26, fifteen of the "military" playing cards 27, and six of the "commander-in-chief" playing cards 28, all as seen in FIG. 3 of the drawings.

Figure 4:
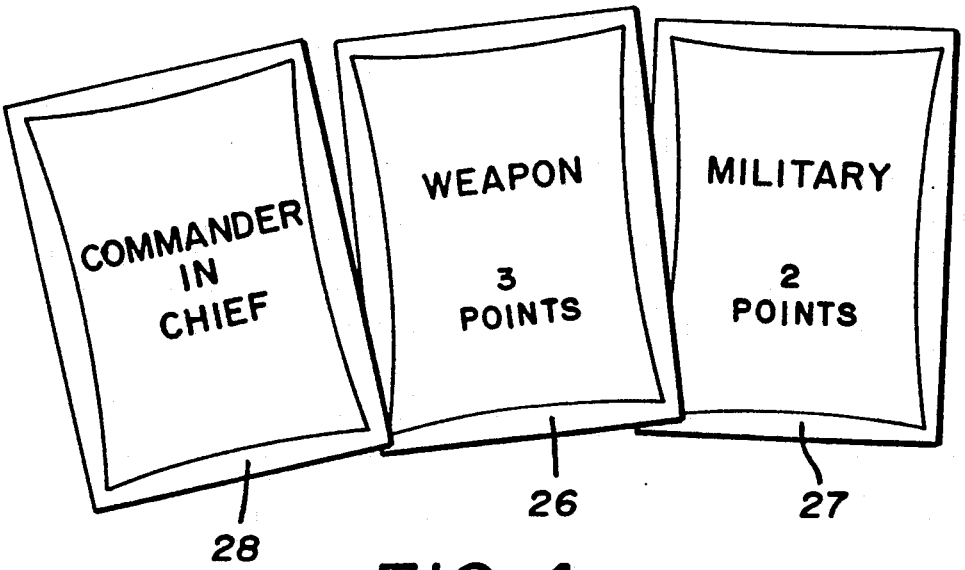
FIG. 4 is a representation of a necessary hand of cards used in playing the game.

By referring now to FIG. 4 of the drawings a so-called hand of the playing cards 28, 27, and 28 has been illustrated.

In playing the game for which the hereinbefore described game board, game pieces, and playing cards are necessary, the following rules relate to the game board, game pieces, and playing cards and provide an example of a game played thereon.

GLOBE

Rules of play

Family Board Game for Ages 9 and up.

Design

Globe has been designed to familiarize students of all ages with the countries that make up each continent and the continents that make up our world. Note: Six continents have been used. The seveth, Antarctica, has been eliminated due to difficulty in positioning the continent on the game board.

Equipment

Game board, four game markers; thirty second timer; thirty-four game cards; the country pieces and tally scoring sheets.

Number of Players

Globe can be played by up to four people.

Object

The object of Globe is to accumulate as many points as possible by: correctly placing countries to their proper positions around the world within thirty seconds; moving game markers around the game board, and, by selling cards. The game ends when all the countries are in their proper positions. The player with the most points at the end of the game wins.

Note: Globe can also be played by using one or any number of continents in a game.

Before play begins

Before the game begins, all the countries are placed upside down in the box provided with the game.

To begin to play

To begin to play, each player rolls the die. The player with the highest roll starts the game. Play continues in a clockwise rotation.

Pick a country blocks

When a player lands on a "pick a country block", he picks up a country, the thirty second timer is started, and the player attempts to locate the country on the game board. If the country is located within thirty seconds, the country is placed over its rightful position and the player receives one point. If a player does not locate its proper position, within thirty seconds, the country is put back and he receives no points. Each country may have its name printed on the top for easy identification. If a player lands on a block that says to pick up more than one country, the player is allowed thirty seconds for each country to be currently positioned. One point is received for each correctly positioned country. Any incorrectly placed countries are put back. The player who positions the last country on a continent receives five points. In a few cases, several countries are connected together and form one piece. If placed correctly, the player receives one point per each country on the piece.

The Military and Weapon Cards

The military and weapon cards are used in any appropriate sequence during play to reduce an opponent's points or protect a player's own countries and points.

Weapon Cards

Weapon cards are collected and used to protect or conquer a country. They can be traded or sold and are worth three points when traded or sold.

Military Cards

Military cards are also used to protect or conquer a country. They can be traded or sold and are worth two points when traded or sold.

To Conquer a Country

A player must have one military, one weapon, and one commander-in-chief card to conquer each country. A player cannot conquer a country until he passes start or completes one full trip around the game board. When a player is ready to conquer a country, he lays down the appropriate cards and tells the other players which country he wishes to conquer. The player who positioned the country loses the points he received for positioning the country. A player can only conquer one country during his turn and the player gives up the right to roll the die. The cards used to conquer the country are shuffled back into the remaining cards. The commander-in-chief cards are kept in a players possession at all times during the game.

To Protect a Country

A player must have one military and one weapon card to protect each country from being conquered. A player can protect any number of his countries with the appropriate cards during his turn. The cards used to protect each country are placed on each country he is protecting. A player cannot conquer a protected country. A player can change or shift protection to any of his countries during his turn. A player cannot attempt to protect a country after it has been conquered. The country must be conquered and protected again.

To Conquer and Protect a Country

A player can conquer and protect a country all in one turn. The player lays down the cards to conquer a country and at the same time places the appropriate cards on top of the country he just conquered. Remember, a player can conquer only one country during his turn, but he can protect as many countries as he wishes as long as he has the appropriate cards for each country.

Commander-in-Chief Cards

One commander-in-chief card is needed to conduct any offensive military actions or negotiations. (Negotiations involve the trading, buying, and selling of cards and is discussed below). The card is kept in the player's possession at all times and must be exposed during any negotiations.

Negotiations

Each player in negotiations must have a commander-in-chief card. Negotiations occur when one player wants to sell, buy, or trade cards (with another player) for military operations, such as protecting or conquering a country. The value of these cards were discussed earlier. To buy cards, a player must give up points he has accumulated during play. A player can only sell, buy, and trade cards during his turn. The player simply asks the other players if they wish to buy, sell, or trade cards.

Hostage Taken Block

If a player lands on this block, he can only be released by: (1.) Rolling a 6 on the die, a player continues to roll during his turn when he is hostage; (2.) any other player lands on one of the hostages released blocks.

The game heretofore described and illustrated is versatile and educational, one or more continents and several countries on the continents challenge a player's geographic abilities and introducing an element of military action enhances the desire to win the game.

Although but one embodiment of the present invention has been illustrated and described, it will be apparent to those skilled in the art that various changes and modifications may be made therein without departing from the spirit of the invention and having thus described my invention,

What I claim is:

1. A method of playing a geographical map game comprising the following steps: providing a game board having a representation of at least one continent of the world thereon, indicia on said continent representing the profiles of political boundaries of countries thereon, providing playing pieces matching the political boundaries of said countries and having indicia thereon identifying the countries represented, providing a plurality of playing cards comprising at least four groups of playing cards, at least one of said groups having instructions "roll again" and a point value thereon, at least another group having the word "weapon" and a point value thereon, at least another group having the word "military" and a point value thereon, and at least another group of said playing cards having the words "commander-in-chief" and a point value thereon, providing a border of representation of blocks around said representation of said continent, providing various instructions on said representation of blocks forming said border for directing players to pick a playing card or pick a country represented by a playing piece, providing a plurality of game markers movable on said representation of blocks, providing a device for random choice of a number indicating the number of blocks a game marker is to be moved on said blocks so as to determine the game instructions appearing on said block, providing a timing device which times out when a predetermined time has elapsed, actuating said random choice device to select a number, placing a game marker on one of said blocks on said game board as indicated by said random selected number, starting said timing device and randomly selecting and placing a game board piece on said game board on the matching country indicia thereon if the instructions on said block so state, picking a playing card from said plurality of playing cards if the instructions on said block so state, determining a total based on the number of game board pieces placed correctly on matching countries on said game board indicia before said time has elapsed and the total number of point values of the playing cards picked up and crediting said total to a player.

2. The method of claim 1 wherein there are representations of at least two continents on said game board.

3. The method of claim 1 wherein several countries are represented on several of said playing pieces.

4. The method of playing a board game with at least one die having a number on each of its faces by a plurality of players comprising the following steps: providing a plurality of game board pieces representing countries, providing a plurality of game markers for said players' use, providing a plurality of playing cards bearing titles of military meanings and different point values, providing a game board having a plurality of playing regions representing continents, each of said playing regions further comprising a plurality of countries matching said game board pieces, providing a plurality of blocks on said game board bearing instructions, rolling said die and observing the number rolled, placing a game marker on one of said blocks on said game board as determined by said observed number, starting a timing device which times out when a predetermined length of time has elapsed, randomly selecting and placing a game board piece on said game board on the matching country in said playing region if the instructions on said block so state, picking a playing card from said plurality of playing cards if the instructions on said block so state, determining a total based on the number of game board pieces placed correctly on matching countries on said game board before said predetermined length of time has elapsed and the total number of point values of the playing cards picked up and crediting said total to a player.

* * * * *